US005909603A

United States Patent [19]

Suzuki et al.

[11] Patent Number: 5,909,603

[45] Date of Patent: Jun. 1, 1999

[54] IMAGE FORMING APPARATUS HAVING DETECTION UNIT FOR DETECTING PRESENCE/ABSENCE OF PROCESS CARTRIDGE

[75] Inventors: Jun Suzuki, Numazu; Masahide Kinoshita, Shizuoka-ken, both of Japan

[73] Assignee: Canon Kabushiki Kaisha, Tokyo, Japan

[21] Appl. No.: 08/900,835

[22] Filed: Jul. 25, 1997

[30] Foreign Application Priority Data

Jul. 26, 1996 [JP] Japan ..... 8-215193

[51] Int. Cl.[6] ..... G03G 15/00

[52] U.S. Cl. ..... 399/13; 340/687

[58] Field of Search ..... 399/13, 90, 111, 399/12; 340/687

[56] References Cited

U.S. PATENT DOCUMENTS

| | | | |
|---|---|---|---|
| 4,839,691 | 6/1989 | Tagawa et al. | 399/12 |
| 4,894,684 | 1/1990 | Nakajima et al. | 399/13 |
| 4,978,995 | 12/1990 | Takahashi | 399/12 |
| 5,103,259 | 4/1992 | Saitoh et al. | 399/13 |
| 5,225,870 | 7/1993 | Tanimoto et al. | 399/13 |
| 5,253,015 | 10/1993 | Morita et al. | 399/13 |
| 5,311,253 | 5/1994 | Ohmori et al. | 399/13 |

FOREIGN PATENT DOCUMENTS

| | | |
|---|---|---|
| 59-061854 | 4/1984 | Japan . |
| 6-149051 | 5/1994 | Japan . |

*Primary Examiner*—Robert Beatty
*Attorney, Agent, or Firm*—Fitzpatrick, Cella, Harper & Scinto

[57] ABSTRACT

An image forming apparatus including a process cartridge detachably attached to a main body the apparatus, the process cartridge having an image bearing member, a processor device acting on the image bearing member, and, storage device for electrically connecting the main body to the process cartridge through a connector, biasing device for biasing the process cartridge in a connecting direction of the connector, and presence/absence detection device for detecting whether the process cartridge is mounted onto the main body, the detection device detecting the presence/absence of the process cartridge after the biasing device operates.

16 Claims, 14 Drawing Sheets

IMAGE FORMING APPARATUS HAVING DETECTION UNIT FOR DETECTING PRESENCE/ABSENCE OF PROCESS CARTRIDGE

BACKGROUND OF THE INVENTION

1. Field of the Invention

The present invention relates to an image forming apparatus such as a copying machine or a printer and, more particularly, to an image forming apparatus having a process cartridge detachably mounted onto the apparatus main body.

The "process cartridge" means a cartridge having a charging means, a developing means, a cleaning means, and an electrophotographic sensitive member (image bearing member), which are integrated and detachably mounted onto the image forming apparatus main body. Alternatively, at least one of the charging means, the developing means, and the cleaning means is integrated with the electrophotographic sensitive member into a cartridge detachably mounted onto an electrophotographic image forming apparatus main body. Alternatively, at least the developing means and the electrophotographic sensitive member are integrated into a cartridge detachably mounted onto the electrophotographic image forming apparatus main body.

2. Related Background Art

For a conventional image forming apparatus using an electrophotographic image forming process, a process cartridge system is employed such that an electrophotographic sensitive member and a process means acting on the electrophotographic sensitive member are integrated into a cartridge detachably mounted onto the image forming apparatus main body. According to this process cartridge system, when the developing agent or photosensitive member is consumed, the user can perform maintenance of the apparatus, e.g., replenish the photosensitive member with the developing agent or exchange it by himself/herself without requiring help of a serviceman, so that the operability can be largely improved. For this reason, the process cartridge system is popularly used for image forming apparatuses.

Some process cartridges have additional functions. For example, as disclosed in Japanese Patent Application Laid-Open No. 59-61854, a nonvolatile memory (RAM) as a memory medium is mounted in the process cartridge. The amount consumed in the image forming apparatus main body is stored in the nonvolatile RAM, and the use limit of the process cartridge is determined on the basis of the stored information, thereby prompting the user to exchange the cartridge. Alternatively, as disclosed in Japanese Patent Application Laid-Open No. 6-149051, a quality code is stored in the above-described nonvolatile RAM at the time of delivery. Unless the quality code coincides with that of the image forming apparatus main body, the image forming operation is disabled, thus assuring apparatus protection.

The conventional process cartridge having the nonvolatile RAM uses a circuit as shown in FIG. 13 to diagnose the nonvolatile RAM, i.e., check whether the nonvolatile RAM itself normally functions, by a so-called check sum method according to the procedure shown in FIG. 14, thereby increasing the reliability.

More specifically, in the conventional image forming apparatus, when a process cartridge 20 is mounted onto an image forming apparatus main body 100 (step 1), a nonvolatile RAM 22 mounted in the process cartridge 20 and a CPU 24 mounted in the image forming apparatus main body 100 are connected through connectors 21 (21A and 21B), and a unique signal (Hi-Low signal) represented by ON/OFF of a predetermined voltage value is sent from the CPU 24 (step 2). The nonvolatile RAM 22 outputs a predetermined signal which is quantitatively converted according to the received signal to the CPU 24. Signal input to the nonvolatile RAM 22 is repeated a plurality of number of times while changing the signal contents. The CPU 24 calculates the sum of output signals.

The CPU 24 reads out an output value stored in a ROM 25 in the image forming apparatus main body in advance in correspondence with each signal output to the nonvolatile RAM 22, and calculates the sum of output values. The CPU 24 compares the sum of outputs from the nonvolatile RAM 22 with the sum of output values read out from the ROM 25 in the image forming apparatus main body 100. If the sums are equal, it is determined that the nonvolatile RAM 22 is normal, and the image forming operation starts (steps 3 and 4).

For the conventional image forming apparatus, the connectors 21 (21A and 21B) are used to connect the image forming apparatus main body 100 to the nonvolatile RAM 22 mounted in the process cartridge 20 such that the process cartridge 20 can be detachably mounted onto the image forming apparatus main body 100. Generally, the connectors 21 are constituted such that the process cartridge 20 is mounted onto the image forming apparatus main body 100 and simultaneously connected to the image forming apparatus main body 100.

When the image forming apparatus is constituted such that, when the process cartridge 20 is mounted onto the image forming apparatus main body 100, the state information of the process cartridge is read out from the memory medium such as a nonvolatile RAM and used for the subsequent image forming operation or apparatus protection, it is important to complete the read operation simultaneously at the time of mounting the process cartridge.

As described above in the related background art, generally, the memory medium such as the nonvolatile RAM 22 mounted in the process cartridge 20 and the image forming apparatus main body 100 are often connected through the connectors 21. The connectors 21 are set such that the process cartridge 20 can be easily connected to the image forming apparatus main body 100 in mounting the process cartridge 20 onto the image forming apparatus main body 100. To increase the reliability of connection, the connectors must have precise accessory components or a shape for facilitating connection.

In an image forming apparatus which communicates with the memory medium 22 mounted in the process cartridge 20 to detect the presence/absence of the process cartridge 20, if a connection failure occurs at the connectors 21, it is erroneously determined that the process cartridge 20 is not mounted even when the process cartridge 20 is properly mounted.

In the image forming apparatus which detects the abnormality of the memory medium 22 itself, when a connection failure occurs at the connectors 21, the memory medium abnormality is erroneously detected although the memory medium itself has no abnormality. In this case, the image forming apparatus performs various control operations on the basis of the erroneous detection result. For this reason, the stability of the operation of the apparatus degrades to lower its reliability.

SUMMARY OF THE INVENTION

It is an object of the present invention to provide a reliable process cartridge and an image forming apparatus which can detect the connection state of connectors arranged between a recording medium mounted in the process cartridge and the image forming apparatus main body, thereby preventing erroneous detection of the presence/absence of the process cartridge and the abnormality of the memory medium itself.

It is another object of the present invention to provide a process cartridge and an image forming apparatus which can prevent an output image abnormality or apparatus fault that occurs when the image forming apparatus reads out erroneously stored contents from a memory medium when the memory medium malfunctions, and an image forming operation or the like is executed on the basis of the readout contents.

It is still another object of the present invention to provide a process cartridge and an image forming apparatus which can prevent erroneous detection when the presence/absence of the process cartridge and a memory medium abnormality are detected upon detecting the connection state of connectors arranged between a relatively inexpensive nonvolatile memory (RAM) as a memory medium mounted in the process cartridge and the image forming apparatus main body, thereby realizing high reliability and usability at a low cost.

It is still another object of the present invention to provide an image forming apparatus comprising a process cartridge detachably attached to an apparatus main body, the process cartridge including an image bearing member, process means acting on the image bearing member, and storage means for electrically connecting the apparatus main body to the process cartridge through a connector;

biasing means for biasing the process cartridge in a connection direction of the connector; and presence/absence detection means for detecting whether the process cartridge is mounted onto the apparatus main body, the detection means detecting the presence/absence of the process cartridge after the biasing means operates.

Other objects, features and advantages of the present invention will be apparent from the following detailed description of the preferred embodiments in conjunction with the accompanying drawings.

DETAILED DESCRIPTION OF THE PREFERRED EMBODIMENTS

A process cartridge and an image forming apparatus of the present invention will be described below in detail with reference to the accompanying drawings.

(First Embodiment)

Figure 1:
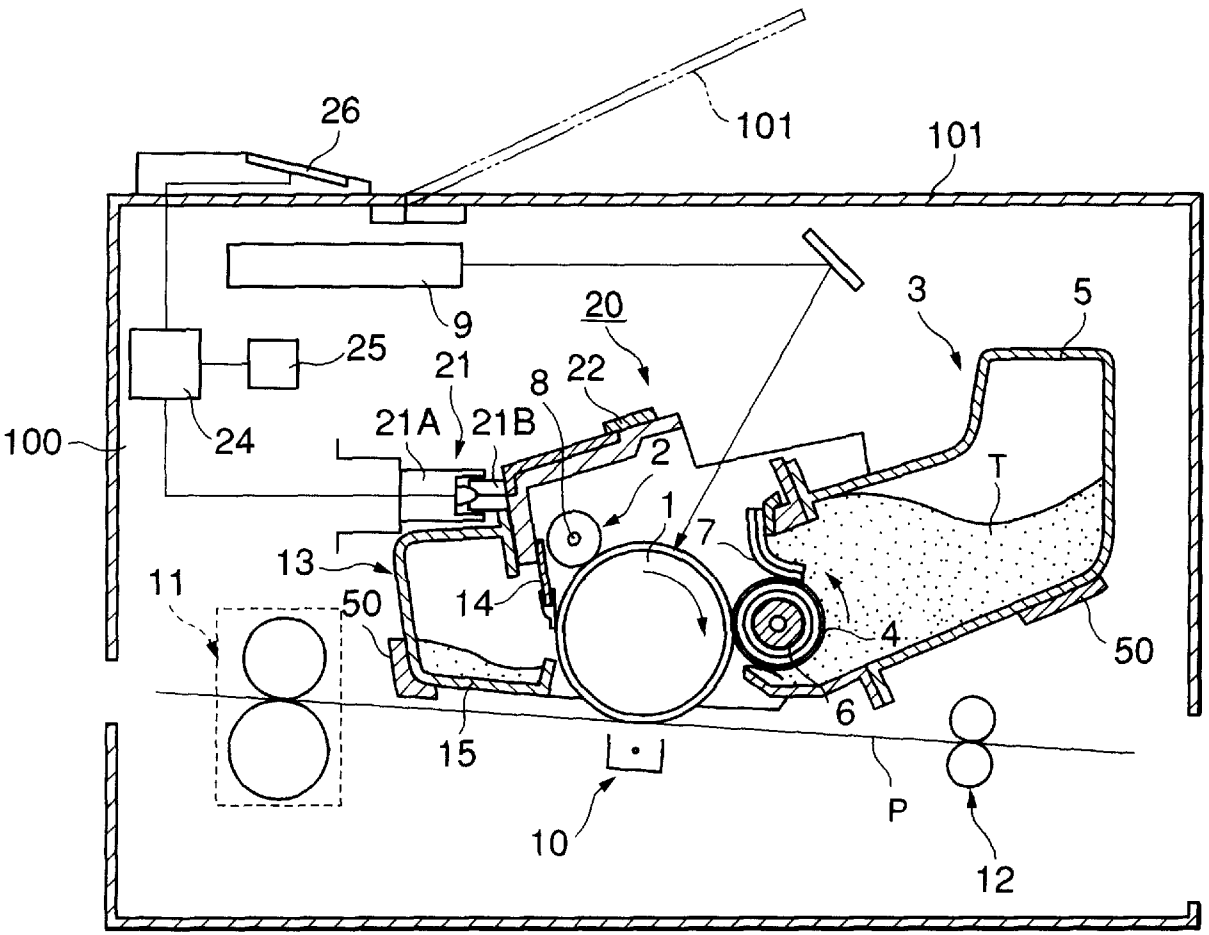
FIG. 1 is a sectional view of a process cartridge according to an embodiment of the present invention and an image forming apparatus using the process cartridge.

FIG. 1 is a sectional side view showing the schematic arrangement of a laser beam printer (to be simply referred to as a "printer" hereinafter) as being representative of the image forming apparatus of the present invention.

In the printer of this embodiment, a drum-shaped electrophotographic sensitive member serving as an image bearing member, i.e., a photosensitive drum 1 is driven by a driving means (not shown) in a direction indicated by an arrow. A charger 2, a developing unit 3, and a cleaning unit 13 are arranged around the photosensitive drum 1. The photosensitive drum 1 is integrated with the process means including the charger 2, the developing unit 3, and the cleaning unit 13 to constitute a process cartridge 20. The process cartridge 20 is detachably mounted onto an apparatus main body 100 through a mounting means 50.

The charger is constituted as a charging roller (contact charging member) 2 to uniformly charge the surface of the photosensitive drum 1. The developing unit 3 has a developing sleeve (developing agent bearing member) 4 formed from, e.g., an aluminum pipe. The developing sleeve 4 is rotatably set at the opening portion which is formed in a developing agent container 5 storing a developing agent T to oppose the photosensitive drum 1. A magnet 6 having a plurality of N and S poles alternated is set in the developing sleeve 4 to be immovable when the developing sleeve 4 rotates. The developing agent T is borne on the surface of the developing sleeve 4 by the magnetic force of the magnet 6.

An elastic blade (developing agent regulating member) 7 abuts against the developing sleeve 4 at the belly of the free end extending in a direction reverse to the rotation direction of the developing sleeve 4. The thickness of the developing agent T borne by the developing sleeve 4 is regulated when the developing agent T passes the abutting portion of the elastic blade 7, so that a thin developing agent layer is formed on the developing sleeve 4. An oscillating voltage obtained by superposing an AC voltage on a DC voltage is applied to a core bar 8 of the charging roller 2 from a power supply (not shown) through a sliding electrode (not shown) contacting the core bar 8. With this arrangement, the outer surface of the photosensitive drum 1 is contact-charged to a predetermined potential.

The charged surface of the photosensitive drum 1 is scanned/exposed with a laser beam emitted from a laser scanner 9 mounted in the image forming apparatus main body 100, thus forming the electrostatic latent image of desired image information.

The developing agent T borne on the developing sleeve 4 is conveyed to the developing unit opposing the photosensitive drum 1 and adheres to the latent image formed on the photosensitive drum 1 by an electric force, so that development is performed. The image formed on the photosensitive drum 1 is transferred onto a recording medium P such, as a transfer sheet, conveyed by a conveying means 12 by a transfer means 10 such as a transfer charger or a transfer roller arranged in the image forming apparatus main body 100. The image on the transfer sheet P is fixed on the transfer sheet P by a fixing unit 11.

The residual developing agent T on the photosensitive drum 1 upon transfer is removed by a cleaning blade 14 of the cleaning unit 13 before the next charging operation and stored in a waste toner container 15.

In the image forming apparatus of this embodiment, a nonvolatile memory (RAM) 22 such as an NV-RAM (NonVolatile-RAM) is mounted in the process cartridge 20. When the process cartridge 20 is mounted onto the image forming apparatus main body 100, the nonvolatile RAM 22 mounted in the process cartridge 20 is connected to a CPU 24 of the image forming apparatus main body 100 through connectors 21. The connectors 21 comprise a connector 21A arranged on the side of the apparatus main body 100 and a connector 21B arranged on the side of the process cartridge 20.

When the process cartridge 20 is mounted onto the apparatus main body 100, and the photosensitive drum 1 rotates, the connection state of the connectors 21 arranged between the memory medium 22 of the process cartridge 20 and the CPU 24 of the image forming apparatus main body is detected to determine the presence/absence of the process cartridge 20. Thereafter, the abnormality of the memory medium 22 is detected.

In this embodiment, the NV-RAM (NonVolatile-RAM) having a memory capacity of 2 kbytes is used as the memory medium 22. Instead, a magnetic memory medium or an optical memory medium may be used. Quality information of the process cartridge 20, including the type and service life of the image bearing member, is stored in the NV-RAM in advance and used for control in the image forming operation.

The operation will be described in more detail with reference to FIG. 4. To form an image by the image forming apparatus of this embodiment, a cover 101 of the image forming apparatus main body 100 is opened upward, and the process cartridge 20 is mounted at a predetermined position through the mounting means 50 (step 1). At this time, the connectors 21 (21A and 21B) respectively provided in the image forming apparatus main body 100 and the NV-RAM 22 of the process cartridge 20 are connected to each other. At this time point, however, the reliability of connection between the connector 21A and the connector 21B is not always 100%.

Figure 2:
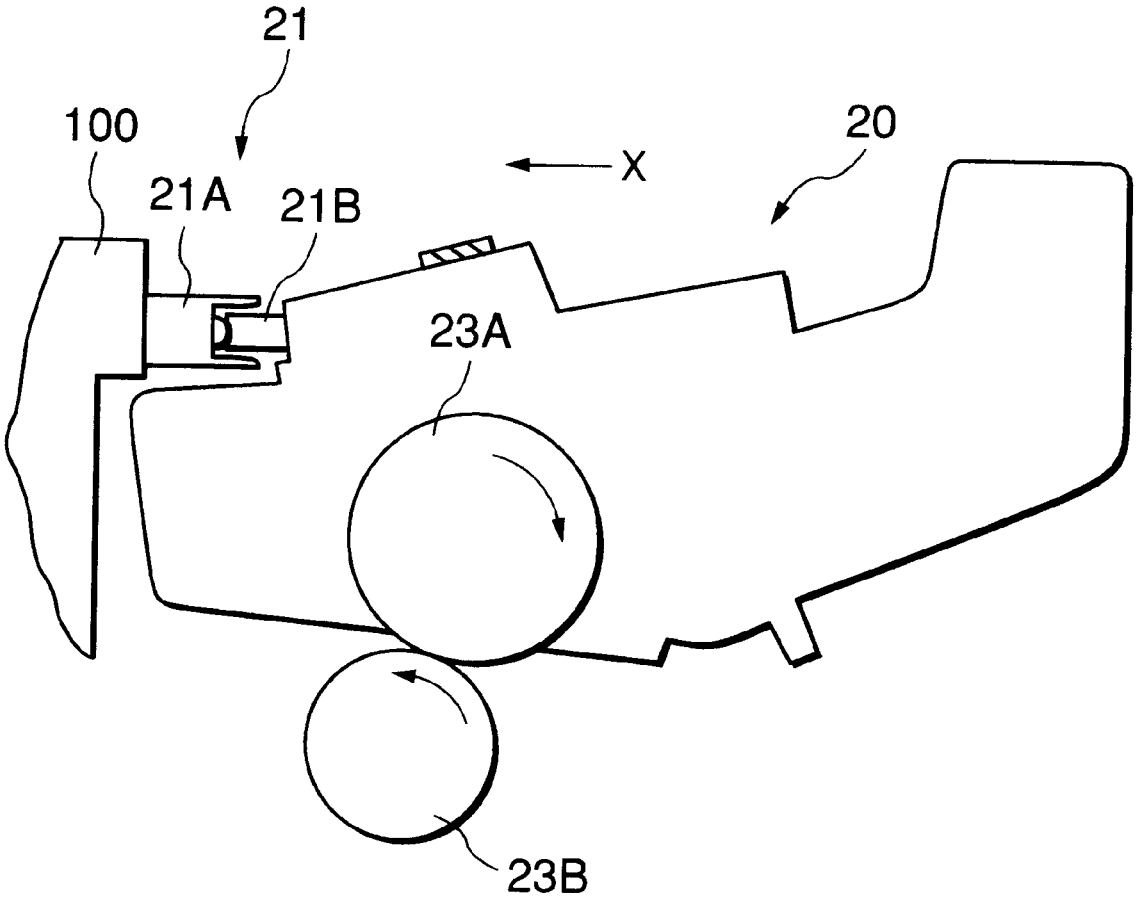
FIG. 2 is an explanatory view for explaining the connection state of connectors in mounting the process cartridges.

The cover 101 of the cover 101 is closed. A driving gear 23B provided in the main body 100 starts to rotate in response to the closing operation of the cover 101. As shown in FIG. 2, a gear 23A provided on the side portion of the photosensitive drum 1 meshes with the image bearing member driving gear 23B provided in the image forming apparatus main body 100 and rotates in a direction indicated by an arrow in FIG. 2 (step 2). As a result, the entire process cartridge 20 is set aside in a direction indicated by an arrow X in FIG. 2. Therefore, the connector 21A on the image forming apparatus main body is pressed against the connector 21B on the side of the NV-RAM 22, so that the connectors are firmly and properly connected to each other. More specifically, at this time, the probability that the connectors 21A and 21B are not connected although the process cartridge 20 having the connector 21B is mounted onto the main body 100 becomes almost zero. This is because the process cartridge 20 is forcibly set aside.

Figure 3:
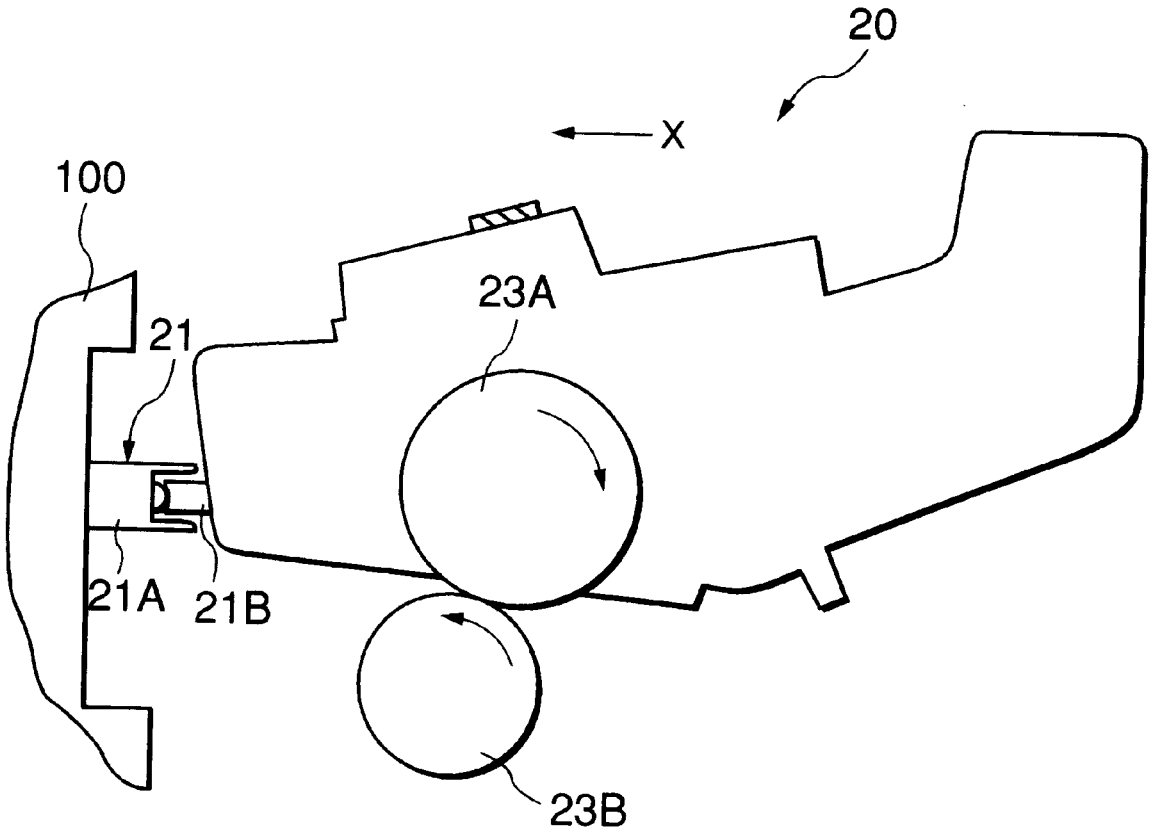
FIG. 3 is an explanatory view for explaining another example of the connection state of the connectors in mounting the process cartridge.

The set position of the connectors 21 is not limited to that shown in FIG. 2. As far as the connectors 21 arranged in the image forming apparatus and the process cartridge are pressed against each other upon setting the process cartridge aside, i.e., even when the connector 21 is set at the distal end portion of the process cartridge 20, as shown in FIG. 3, the same effect as described above can be obtained.

After rotation of the photosensitive drum 1 stops, a voltage of 5 V is applied from the image forming apparatus main body 100 to the nonvolatile RAM 22. With this operation, the connection state of the connectors 21 is detected to confirm the presence/absence of the cartridge (steps 3 and 4). In this case, if conduction is obtained between the image forming apparatus main body 100 and the NV-RAM 22, it is determined that the process cartridge 20 having the NV-RAM is mounted, and the process shifts to the subsequent NV-RAM abnormality detection operation (step 6).

However, if no conduction is obtained between the image forming apparatus main body 100 and the NV-RAM 22, the CPU 24 mounted in the image forming apparatus main body 100 performs control to display an alarm message "no cartridge" on a display unit 26 (step 5).

More specifically, the reliability of connection between the connectors 21A and 21B should have reached almost 100% after step 3. Accordingly, if no conduction is obtained between the main body 100 and the NV-RAM 22 in step 4, it can be determined that no cartridge is mounted.

Since conduction between the main body 100 and the NV-RAM 22 is detected not immediately after the cartridge is mounted but after the photosensitive member is temporarily rotated (i.e., after the cartridge is biased in a direction for connecting the connectors), the presence/absence of the cartridge can be properly determined. More specifically, even when the cartridge is mounted, and the connectors are not properly fitted, erroneous determination "no cartridge" can be prevented, so that the user can be notified of correct information.

The abnormality of the NV-RAM 22 is detected according to the check sum method as follows. When a unique signal represented by ON/OFF of a predetermined voltage value is sent from the CPU 24 incorporated in the image forming apparatus main body 100 to the NV-RAM 22, a predetermined signal which is quantitatively converted in accordance with the signal input to the NV-RAM is output from the NV-RAM 22 to the CPU 24. Signal input to the NV-RAM 22 is repeated a plurality of number of times while changing the signal contents. The CPU 24 calculates the sum of output signals from the NV-RAM 22.

The CPU 24 reads out an output value stored in the ROM 25 in the image forming apparatus main body in advance in correspondence with each signal output to the NV-RAM 22, and calculates the sum of output values.

The CPU 24 compares the sum of outputs from the NV-RAM 22 with the sum of output values read out from the ROM 25 in the image forming apparatus. If the sums are equal, it is determined that the NV-RAM 22 is normal, and the image forming operation starts (steps 6 and 8). The quality information of the process cartridge 20, including the type and service life of the photosensitive drum, is read out from the NV-RAM 22 by the CPU 24 and referred to and used as control condition setting factors for the image forming operation.

When comparison between the sum of outputs from the nonvolatile RAM 22 and the sum of output values read out from the ROM 25 in the image forming apparatus reveals that the sums are different, the CPU 24 performs a control operation to display an alarm message "RAM abnormality" on the display 26 (step 2).

In the image forming apparatus of this embodiment, after the photosensitive member is rotated, the connection state of the connectors 21 provided between the NV-RAM 22 and the image forming apparatus main body 100 is detected, thereby detecting the presence/absence of the process cartridge 20 and the abnormality of the NV-RAM 22 itself. With this arrangement, the user can be properly notified of the information of the presence/absence of the process cartridge 20 and the RAM abnormality information.

In addition, since the quality information of the process cartridge 20, which is stored in the memory medium 22 mounted in the process cartridge 20, is referred to and used as control condition setting factors for the image forming operation, the image forming conditions can be finely controlled in accordance with the state of the process cartridge 20. When the relatively inexpensive NV-RAM is used as the memory medium 22, the above-described control contents can be practiced at a low cost.

(Second Embodiment)

Figure 5:
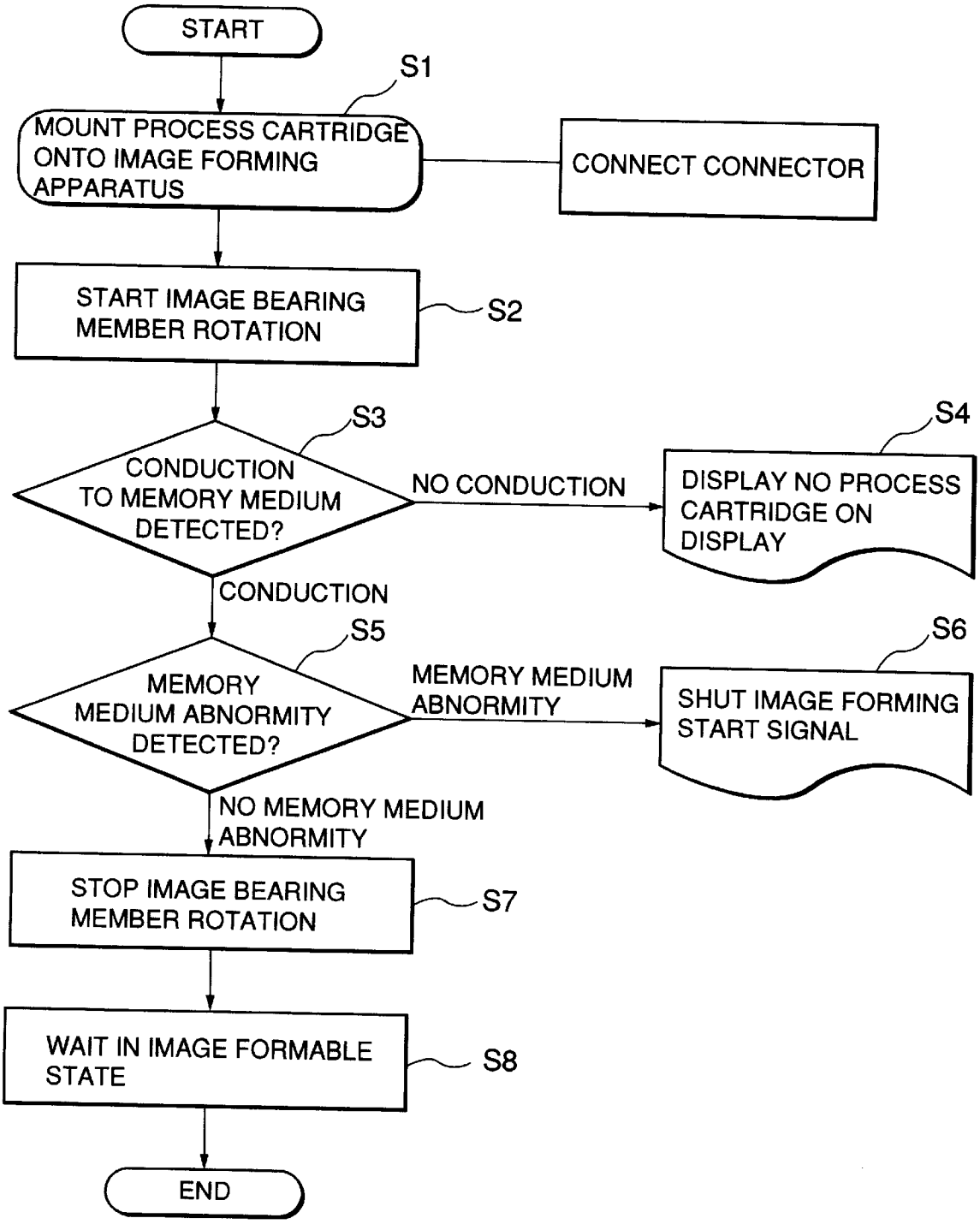
FIG. 5 is a flowchart showing the procedure of detecting the presence/absence of a process cartridge and a memory medium abnormality in mounting the process cartridge according to the second embodiment.

FIG. 5 is a flowchart showing the procedure of detecting the presence/absence of a process cartridge 20 and a memory medium abnormality in mounting the process cartridge 20 onto an image forming apparatus main body 100 in the second embodiment of the present invention.

The image forming apparatus of this embodiment has the same arrangement as that of the first embodiment. This embodiment is different from the first embodiment in the following points. The connection state of connectors 21 arranged between a memory medium 22 of the process cartridge 20 and the image forming apparatus main body 100 is detected during rotation of a photosensitive drum 1 to determine the presence/absence of the process cartridge 20 (steps 3 and 4), and thereafter, the memory medium abnormality is detected (step 5). In addition, when the abnormality of the memory medium 22 is detected, the image forming start signal is shut off to protect the apparatus, thereby disabling the image forming operation (step 6).

In the image forming apparatus of this embodiment, the photosensitive drum 1 is rotated, and simultaneously, the connection state of the connectors 21 arranged between the NV-RAM 22 and the image forming apparatus main body 100 is detected to detect the presence/absence of the process cartridge and the abnormality of the memory medium itself (steps 2, 3, and 5). With this arrangement, erroneous detection due to a connection failure of the connectors can be prevented, and the time required for each detection operation can be shortened.

In addition, this arrangement allows prevention of an output image abnormality or apparatus fault that occurs when the image forming apparatus side reads out erroneous storage contents from the NV-RAM 22 when the NV-RAM 22 serving as a memory medium malfunctions, and the image forming operation or the like is executed on the basis of the readout contents. Furthermore, since the quality information of the process cartridge 20, which is stored in the memory medium 22 mounted in the process cartridge 20, is referred to and used as control condition setting factors for the image forming operation, the image forming conditions can be finely controlled in accordance with the state of the process cartridge 20. When the relatively inexpensive NV-RAM is used as the memory medium, the above-described control contents can be practiced at a low cost.

(Third Embodiment)

Figure 6:
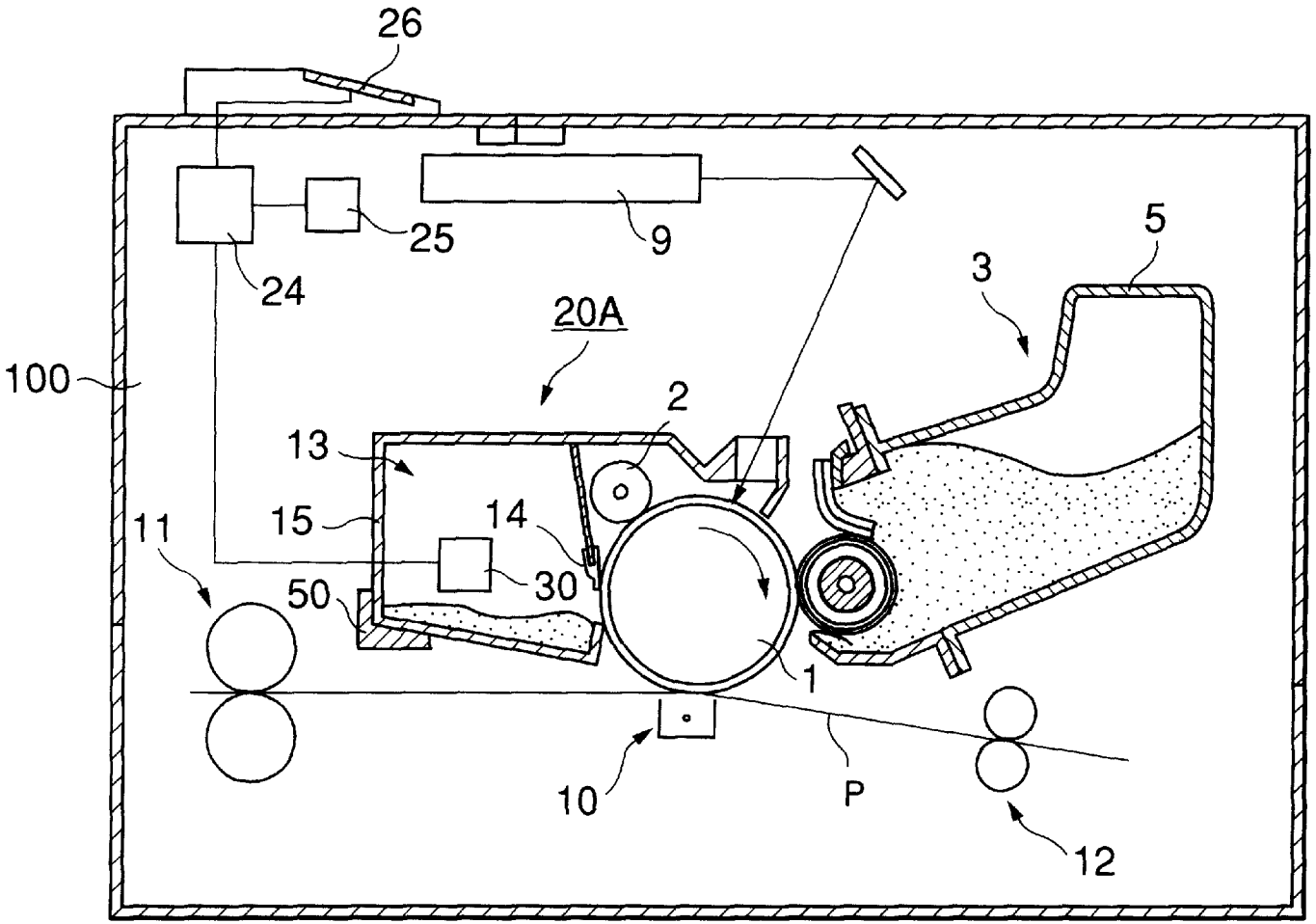
FIG. 6 is a sectional view of a process cartridge according to another embodiment of the present invention and an image forming apparatus using the process cartridge.

FIG. 6 shows a process cartridge and an image forming apparatus according to the third embodiment of the present invention.

In this embodiment, a process cartridge 20A is constituted by integrating a photosensitive drum 1, a charging roller 2, and a cleaning unit 13. A developing unit 3 is formed as a separate unit. The cleaning unit 13 has a cleaning blade 14 and a waste toner container 15. The remaining portions are the same as those of the image forming apparatus of the first embodiment. The same reference numerals as in the first embodiment denote the same members in the third embodiment, and a detailed description thereof will be omitted.

In the image forming apparatus of this embodiment, a CPU 24, a ROM 25, and a display 26 are arranged on an image forming apparatus main body 100, so that the presence/absence of the process cartridge 20A and the abnormality of the NV-RAM as a memory medium mounted in the process cartridge 20A are detected, as in the image forming apparatus of the first embodiment.

Figure 7:
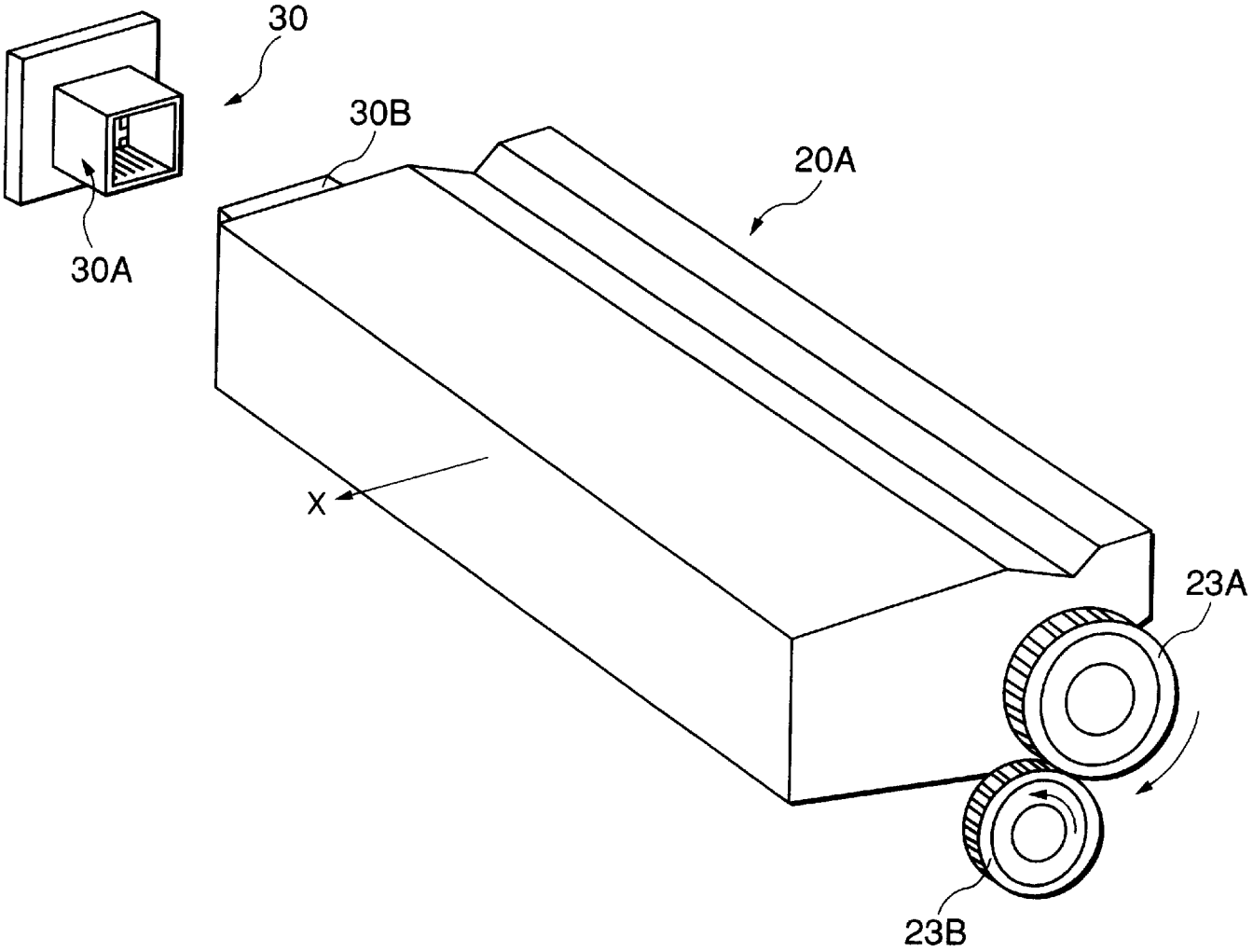
FIG. 7 is a perspective view for explaining the connection state of connectors in mounting the process cartridge.
Figure 8:
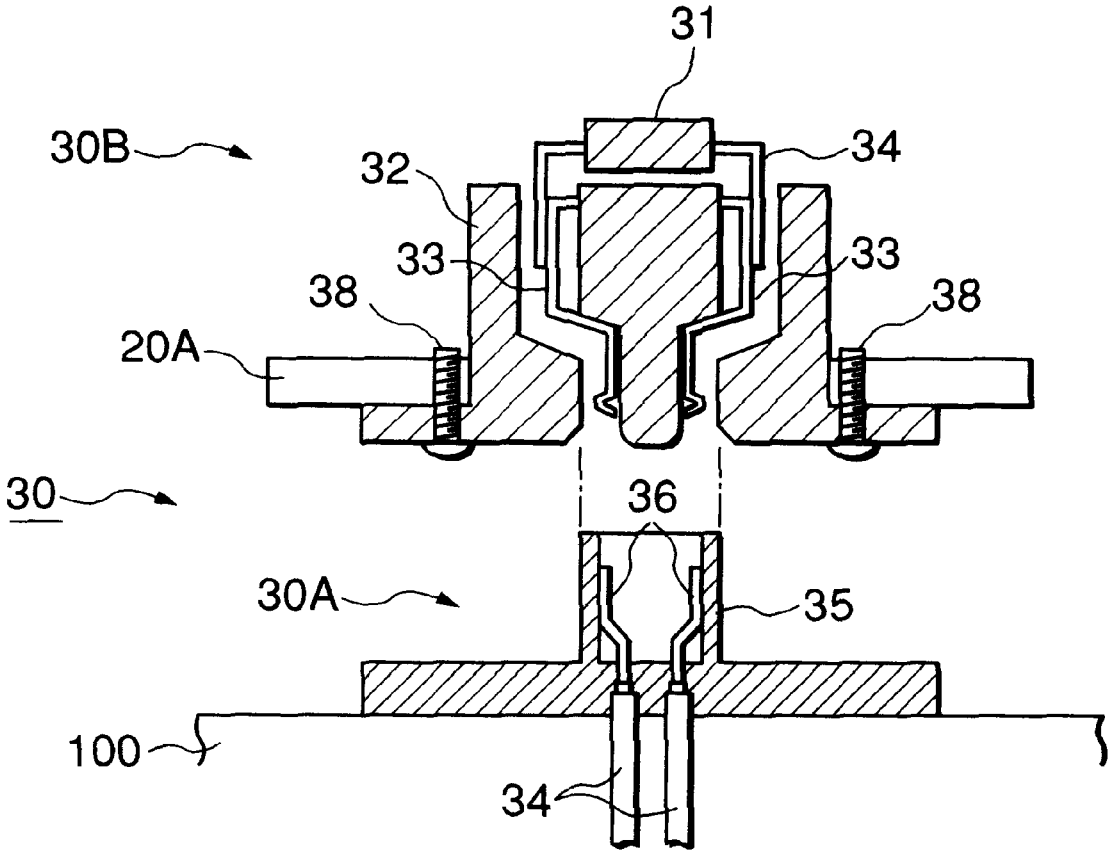
FIG. 8 is a sectional view of a connector (female connector) integrated NV-RAM and a male connector attached on the image forming apparatus main body.
Figure 9:
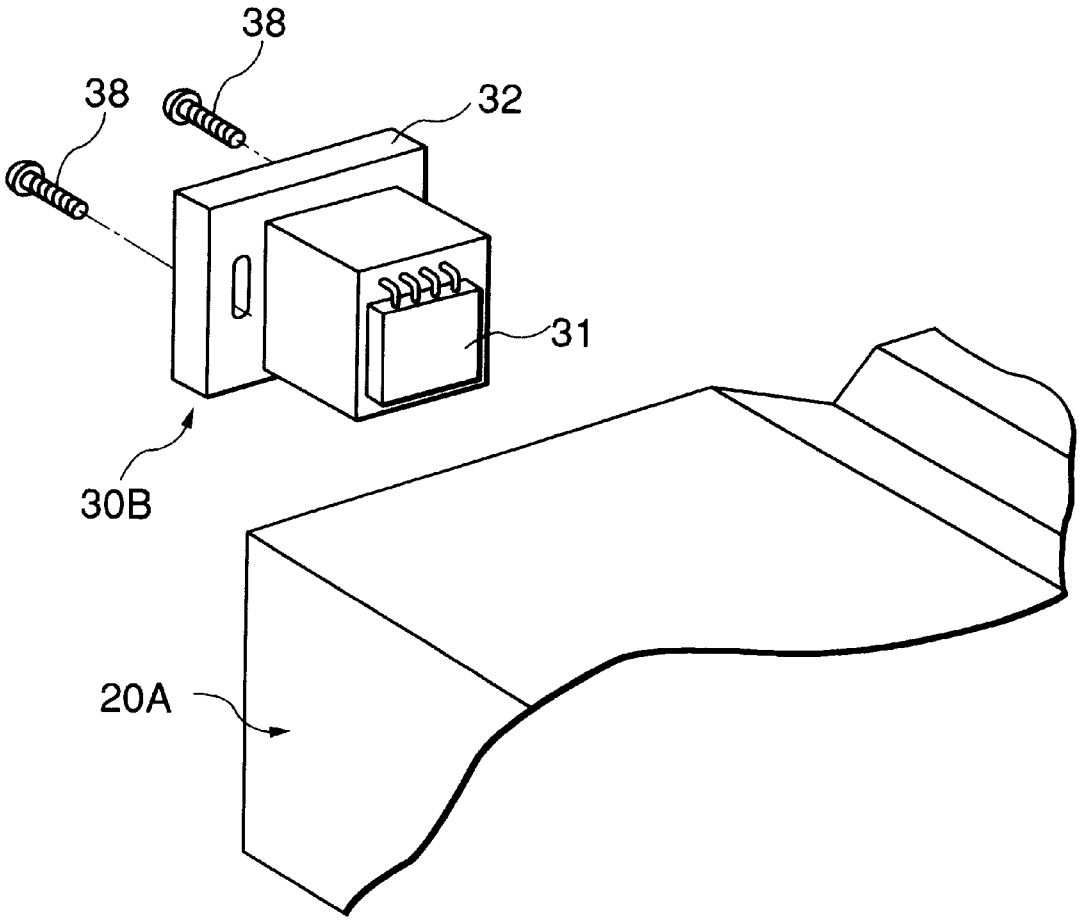
FIG. 9 is a perspective view for explaining the attached state of the connector integrated NV-RAM to the process cartridge.

In this embodiment, as shown in FIGS. 7 to 9, the image forming apparatus main body 100 and the process cartridge 20A are connected through connectors 30. The connectors 30 comprise a male connector 30A set in the image forming apparatus main body 100, and a female connector integrated NV-RAM 30B arranged on the side of a process cartridge 20A. The process cartridge 20A is mounted through the side surface of the image forming apparatus main body 100. Therefore, the connector integrated NV-RAM 30B is fixed on the side surface of the process cartridge 20A with screws 38, as shown in FIG. 9.

As shown in FIG. 8, the connector integrated NV-RAM 30B is constituted by an NV-RAM 31, a female connector base 32, and contact fitments 33 attached to the female connector base 32. Contacts 34 of the NV-RAM 31 are connected to the contact fitments 33. In the male connector 30A attached to the image forming apparatus main body 100, lead lines 34 connected to a CPU (not shown) are connected to contact fitments 36 attached to a male connector base 35.

Figure 10:
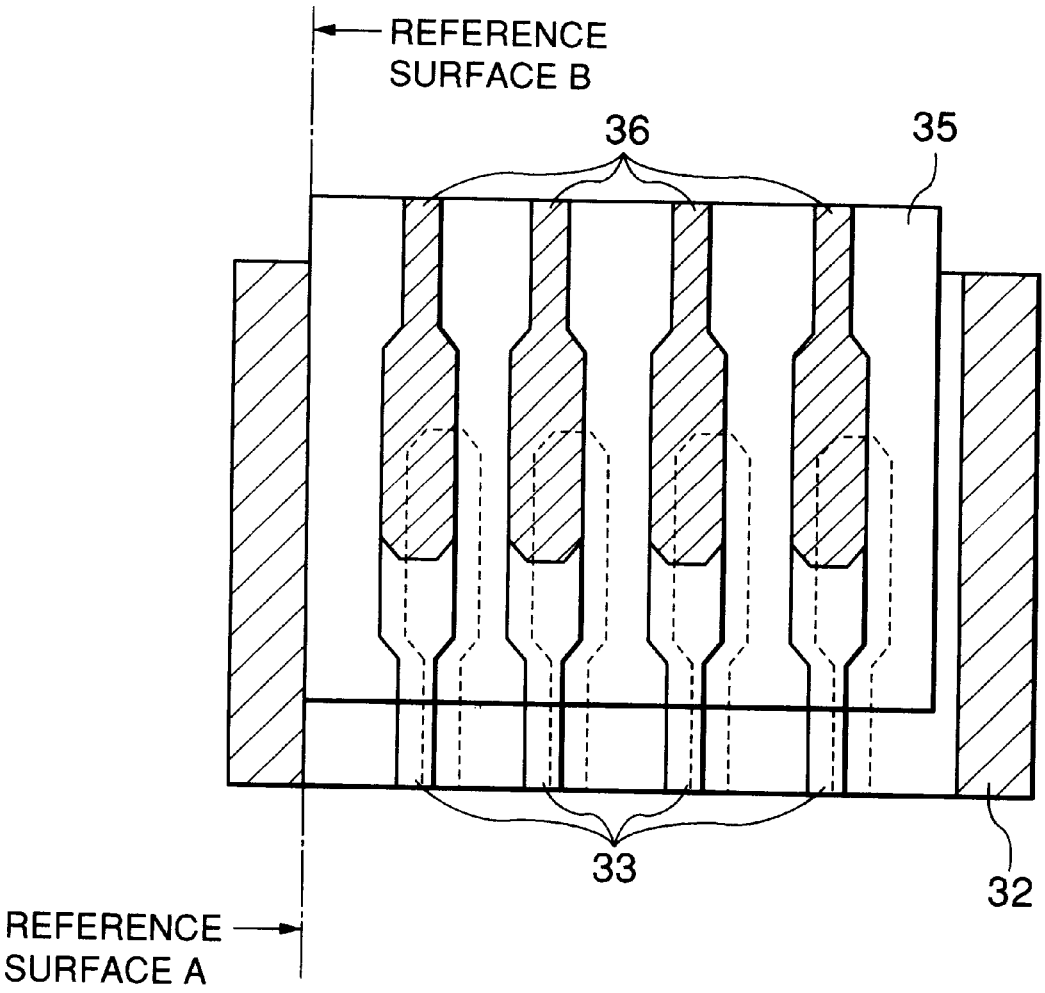
FIG. 10 is a schematic view for explaining the connection state of the connector integrated NV-RAM.

FIG. 10 shows a state wherein the connectors 30 of FIG. 8 are rotated by 90° to connect the male connector 30A to the female connector 30B. The female connector base 32 has a reference surface A, and the male connector base 35 has a reference surface B. When the both reference surfaces match, the contact fitments 33 and 36 are normally connected.

This will be described in more detail. When the process cartridge 20A is inserted into the apparatus main body 100 through the side surface of the image forming apparatus, the base 35 of the male connector 30A attached to the image forming apparatus main body 100 is fitted in the base 32 of the connector integrated NV-RAM 30B of the process cartridge 20A. At this time, the contact fitments 33 attached to the female connector base 32 are connected to the contact fitments 36 attached to the male connector base 35 at positions indicated by broken lines in FIG. 10.

When the process cartridge 20A is mounted onto the image forming apparatus main body 100 through the side surface, a gear 23A provided on the side portion of the photosensitive drum 1 meshes with an image bearing member driving gear 23B provided in the image forming apparatus main body 100 and rotates in a direction indicated by an arrow, as shown in FIG. 7. As a result, the entire process cartridge 20A is set aside in a direction indicated by an arrow X in FIG. 7. Simultaneously, the connector integrated NV-RAM 30B attached to the process cartridge 20A also moves in the direction indicated by the arrow X in FIG. 7. In FIG. 10, the reference surface B of the male connector 30A is pressed against the reference surface A of the connector integrated NV-RAM 30B. When these reference surfaces match, the contact fitments 33 and 36 are fixed at positions indicated by solid lines in FIG. 10. The contacts 33 of the female connector base 32 are properly rendered conductive with the contact fitments 36 of the male connector base 35.

In the image forming apparatus of this embodiment, after the image bearing member 1 stops its rotation, the presence/absence of the process cartridge 20A and the abnormality of the NV-RAM 31 are detected following the same procedure as that of the image forming apparatus of the first embodiment.

In the image forming apparatus of this embodiment, the connection state of the connector integrated NV-RAM 30B and the connector 30A provided in the image forming apparatus main body 100 is detected, thereby preventing erroneous detection of the presence/absence of the process cartridge 20 and the abnormality of the NV-RAM 31 itself. Therefore, the reliability of the image forming apparatus and the process cartridge 20A can be increased.

In addition, the memory medium 31 mounted in the process cartridge 20A is integrated with a connector to form the connector integrated NV-RAM 30B. With this arrangement, an improvement in assembly properties and cost reduction by simplifying the components can be realized. The set position of the connector integrated NV-RAM 30B is not limited to that of this embodiment. As far as the connectors arranged in the image forming apparatus and the process cartridge are pressed against each other upon setting the process cartridge aside, the same effect as described above can be obtained.

(Fourth Embodiment)

In the first to third embodiments, the present invention is applied to a laser beam printer which transfers a toner image formed on the photosensitive drum onto the transfer sheet P. In the fourth embodiment, the present invention is applied to a color laser beam printer which temporarily transfers a toner image formed on a photosensitive drum 71 onto a transfer unit, and toner images are transferred from the transfer unit onto a transfer sheet P at once, as shown in FIG. 11.

Figure 11:
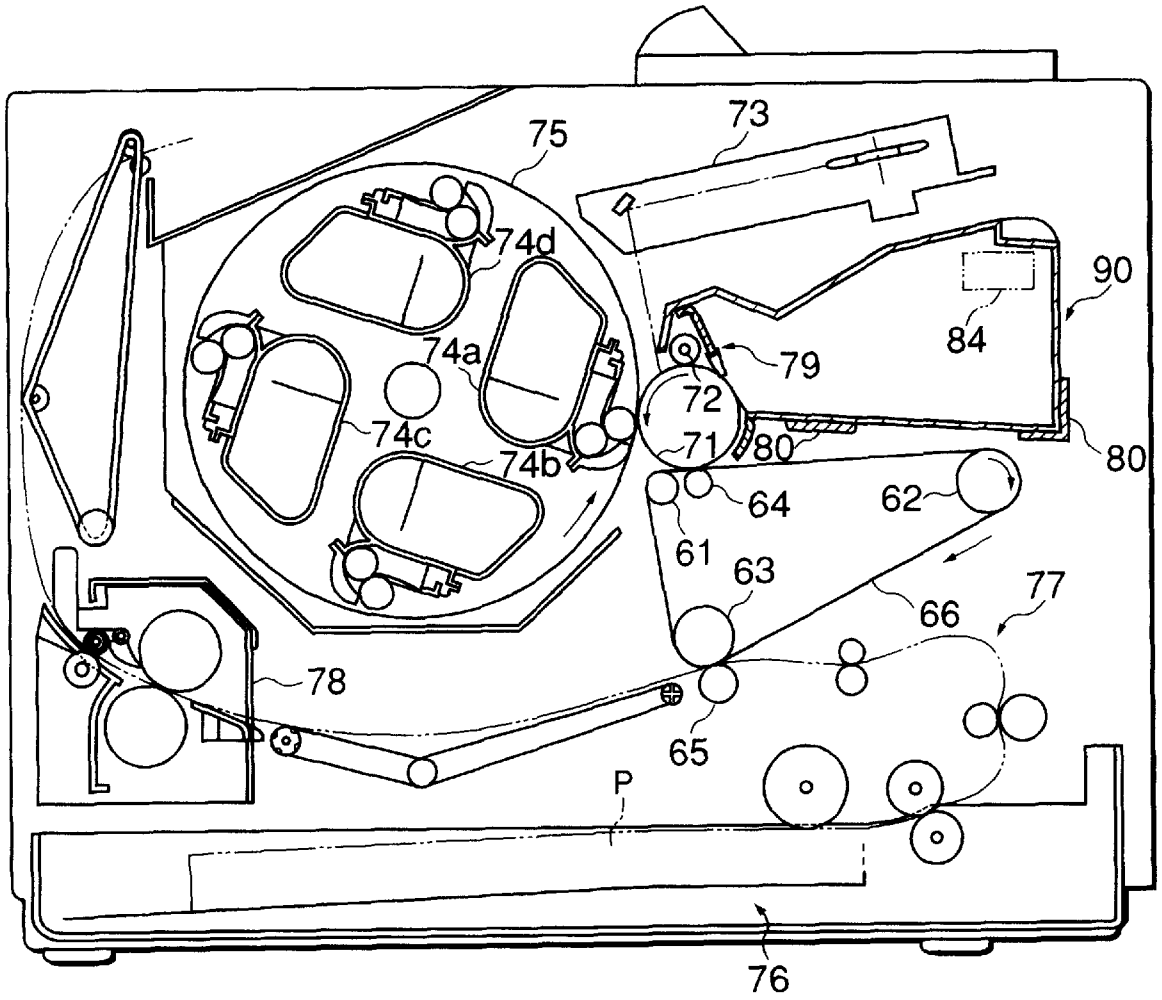
FIG. 11 is a sectional view of a process cartridge according to still another embodiment of the present invention and an image forming apparatus using the process cartridge.

In FIG. 11, the photosensitive drum 71 is driven by a driving means (not shown) in a direction indicated by an arrow and uniformly charged to a predetermined potential by a roller charger 72. Upon receiving a signal corresponding to an yellow image pattern, an exposure unit 73 irradiates a laser beam on the photosensitive drum 71 to form a latent image on the photosensitive drum 71.

As the photosensitive drum 71 rotates in the direction indicated by the arrow, a supporting member 75 rotates to cause, of developing units 74*a* to 74*d* supported by the supporting member 75, the developing unit 74*a* storing a yellow toner to oppose the photosensitive drum 71. The latent image is made visible by the developing unit 74*a*. Next, the developed toner image is transferred onto an intermediate transfer belt 66 serving as an intermediate transfer member.

The intermediate transfer belt 66 is extended on three supporting rollers 61 to 63. When the supporting roller 62 coupled to a driving source rotates, the intermediate transfer belt 66 moves in a direction indicated by an arrow in FIG. 11. A primary transfer roller 64 is arranged inside the intermediate transfer belt 66 at a portion opposing the photosensitive drum. A predetermined bias voltage is applied from a high-voltage power supply (not shown) to the primary transfer roller 64, so that the toner on the photosensitive drum 71 is transferred onto the intermediate transfer belt 66.

When the above process is performed by the developing units 74*b* to 74*d* in the order of magenta, cyan, and black, four color toner images are formed on the intermediate transfer belt 66. The four color toner images are transferred by a secondary transfer roller 65 at once onto the transfer sheet P which is conveyed from a sheet feeding unit 76 through a conveying means 77 in synchronism with the movement of the intermediate transfer belt 66. The toner images on the transfer sheet P are fused/fixed by a heating/pressurizing fixing unit 78, thus obtaining a color image. The residual toner on the photosensitive drum 71 upon transfer is cleaned by a cleaning unit 79 having a blade means.

Figure 12:
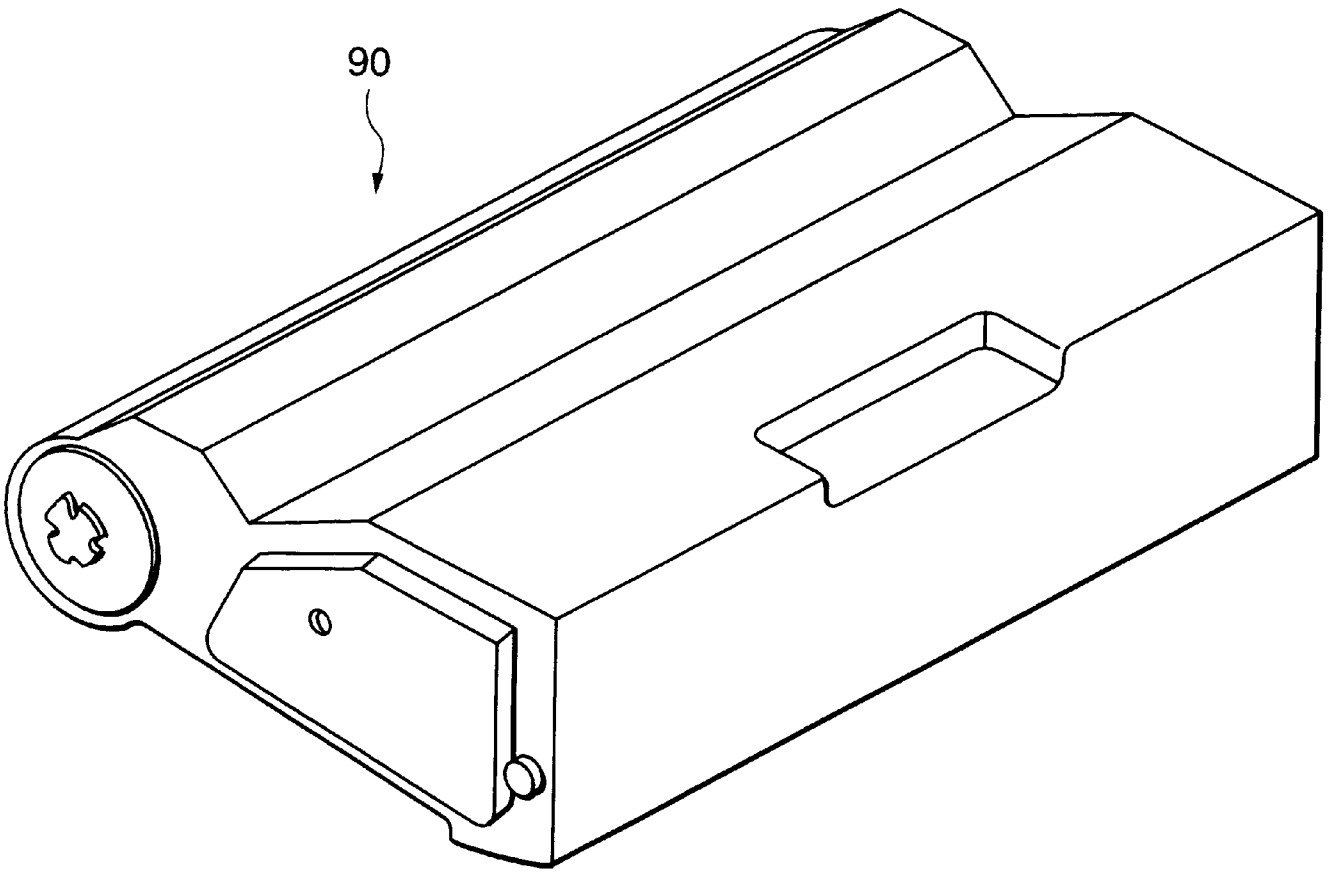
FIG. 12 is a perspective view of the process cartridge shown in FIG. 11.
Figure 13:
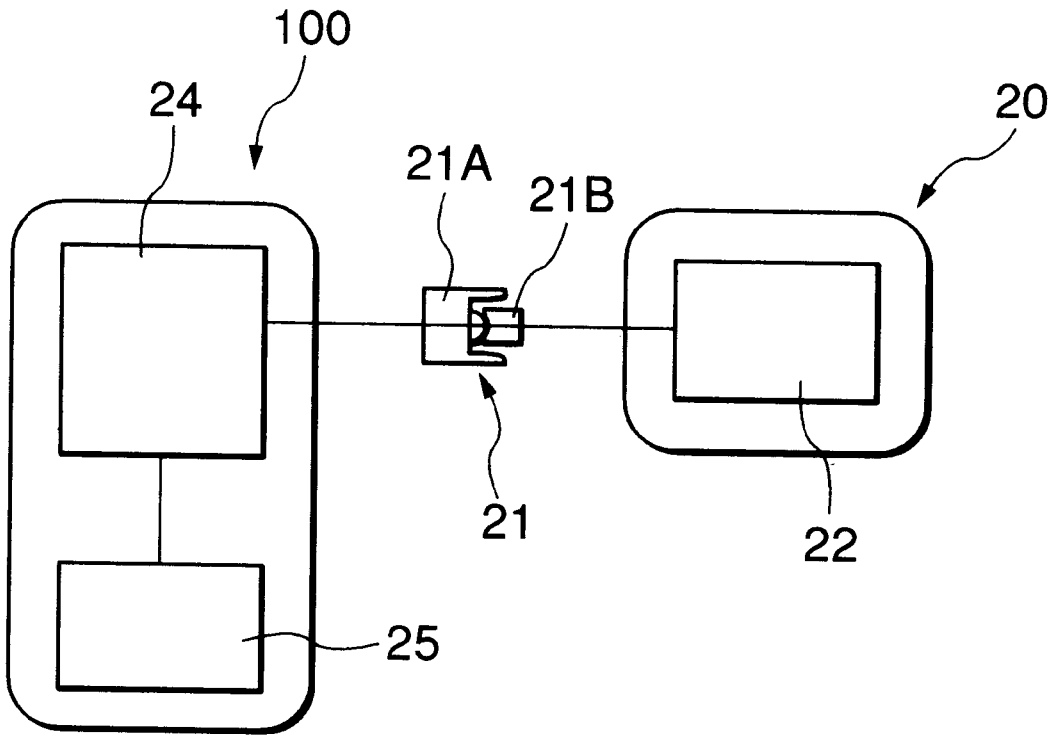
FIG. 13 is a block diagram for explaining the arrangement of an NV-RAM mounted in a process cartridge and other constituent elements.

In this embodiment, as can be seen from FIG. 12, the roller charger 72, the photosensitive drum 71, and the cleaning unit 79 are integrated to form a process cartridge 90 detachably attached to the apparatus main body by a mounting guide means 80. As in the above embodiments, the process cartridge has a nonvolatile memory having first and second connectors, and a connector 84 having the same function as described above.

The four color developing units 74*a* to 74*d* are also detachably attached to the apparatus main body, like the process cartridge. This arrangement allows the user to easily perform exchange and maintenance of the above members, which are conventionally performed by a serviceman.

When the present invention described in the first to third embodiments is applied to the full-color image forming apparatus having the above arrangement, the same function/effect as described above can be obtained.

The present invention is not limited to the above embodiments and also incorporates modifications of the same technical concept.

What is claimed is:

1. An image forming apparatus comprising:

a process cartridge detachably attached to a main body of said apparatus, said process cartridge including an image bearing member, process means acting on said image bearing member, and storage means for electrically connecting said main body to said process cartridge through a connector;

biasing means for biasing said process cartridge in a connecting direction of said connector; and presence/absence detection means for detecting whether said process cartridge is mounted onto said main body or not, said detection means detecting the presence/absence of said process cartridge after said biasing means operates.

2. An image forming apparatus according to claim 1, wherein said detection means detects the presence/absence of said process cartridge on the basis of whether said storage means can be energized.

3. An image forming apparatus according to claim 1, wherein said biasing means includes a driving gear engaging with a gear on said process cartridge and biases said process cartridge in the connecting direction by rotating said driving gear.

4. An image forming apparatus according to claim 3, wherein said driving gear drives said image bearing member.

5. An image forming apparatus according to claim 1, further comprising abnormality detection means for detecting, whether said storage means is normal.

6. An image forming apparatus according to claim 5, wherein said abnormality detection means operates after said presence/absence detection means detects the presence/absence of said process cartridge.

7. An image forming apparatus according to claim 1, wherein said storage means includes a nonvolatile RAM.

8. An image forming apparatus according to claim 1, wherein said image bearing member is an electrophotographic sensitive member.

9. An image forming apparatus according to claim 8, wherein said process means mounted in said process cartridge is at least one of charging means for charging said electrophotographic sensitive member, developing means for supplying a developing agent to said electrophotographic sensitive member, and cleaning means for cleaning said electrophotographic sensitive member.

10. An image forming apparatus according to claim 1, wherein said main body includes a cover to be opened and closed for inserting and removing said cartridge, said biasing means starts to operate when said cover is closed.

11. An image forming apparatus, comprising:

a process cartridge detachably attached to a main body of said apparatus, said process cartridge including an image bearing member, process means acting on said image bearing member, and storage means for electrically connecting said main body to said process cartridge through a connector;

biasing means for biasing said process cartridge in a connecting direction of said connector; and conduction detection means for detecting whether said storage means and said main body are connected or not, said conduction detection means detecting conduction after said biasing means is operated.

12. An image forming apparatus according to claim 11, wherein said biasing means includes a driving gear engaging with a gear on said process cartridge and biases said process cartridge in the connecting direction by rotating said driving gear.

13. An image forming apparatus according to claim 12, wherein said driving gear drives said image bearing member.

14. An image forming apparatus according to claim 11, wherein said storage means includes nonvolatile RAM.

15. An image forming apparatus according to claim 11, wherein said image bearing member is an electrophotographic sensitive member.

16. An image forming apparatus according to claim 15, wherein said process means mounted on said process cartridge is at least one of charging means for charging said electrophotographic sensitive member, developing means for supplying a developing agent to said electrophotographic sensitive member, and cleaning means for cleaning said electrophotographic sensitive member, and cleaning means for cleaning said electrophotographic sensitive member.

* * * * *

UNITED STATES PATENT AND TRADEMARK OFFICE

CERTIFICATE OF CORRECTION

PATENT NO. : 5,909,603

DATED : June 1, 1999

INVENTOR(S) : JUN SUZUKI, ET AL.

It is certified that error appears in the above-identified patent and that said Letters Patent is hereby corrected as shown below:

COVER PAGE AT ITEM [22],
Insert --This patent issued on a continued prosecution application filed under 37 CFR 1.53(d), and is subject to the twenty year patent term provisions of 35 U.S.C. 154(a)(2)"--.

COVER PAGE AT ITEM [57] ABSTRACT,
Line 2, "body" should read --body of--.

Figure 4:
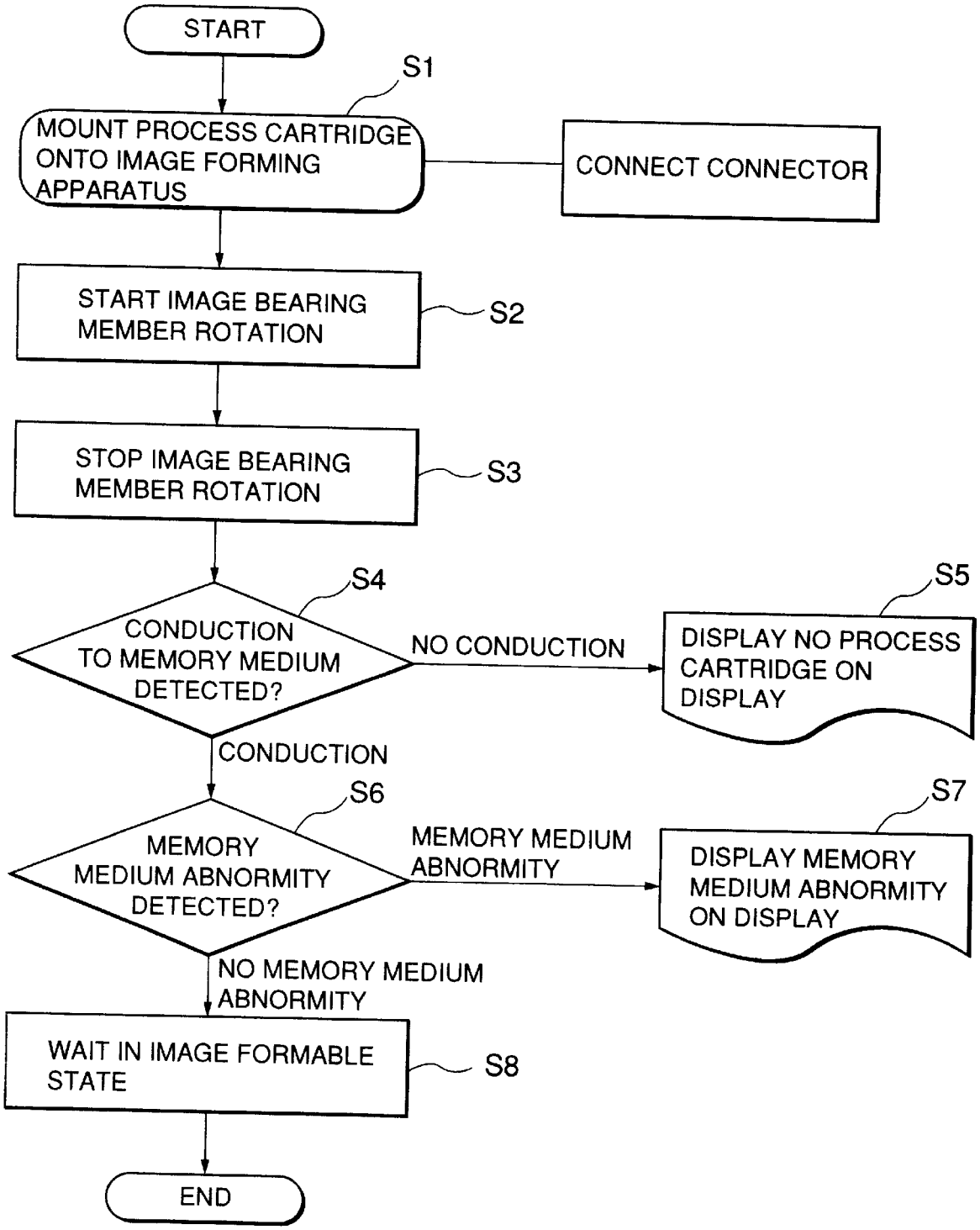
FIG. 4 is a flowchart showing the procedure of detecting the presence/absence of a process cartridge and a memory medium abnormality in mounting the process cartridge according to the first embodiment.

FIGURE 4,
"ABNORMITY" (all occurrences) should read --ABNORMALITY--.

FIGURE 5,
"ABNORMITY" (all occurrences) should read --ABNORMALITY--.

Figure 14:
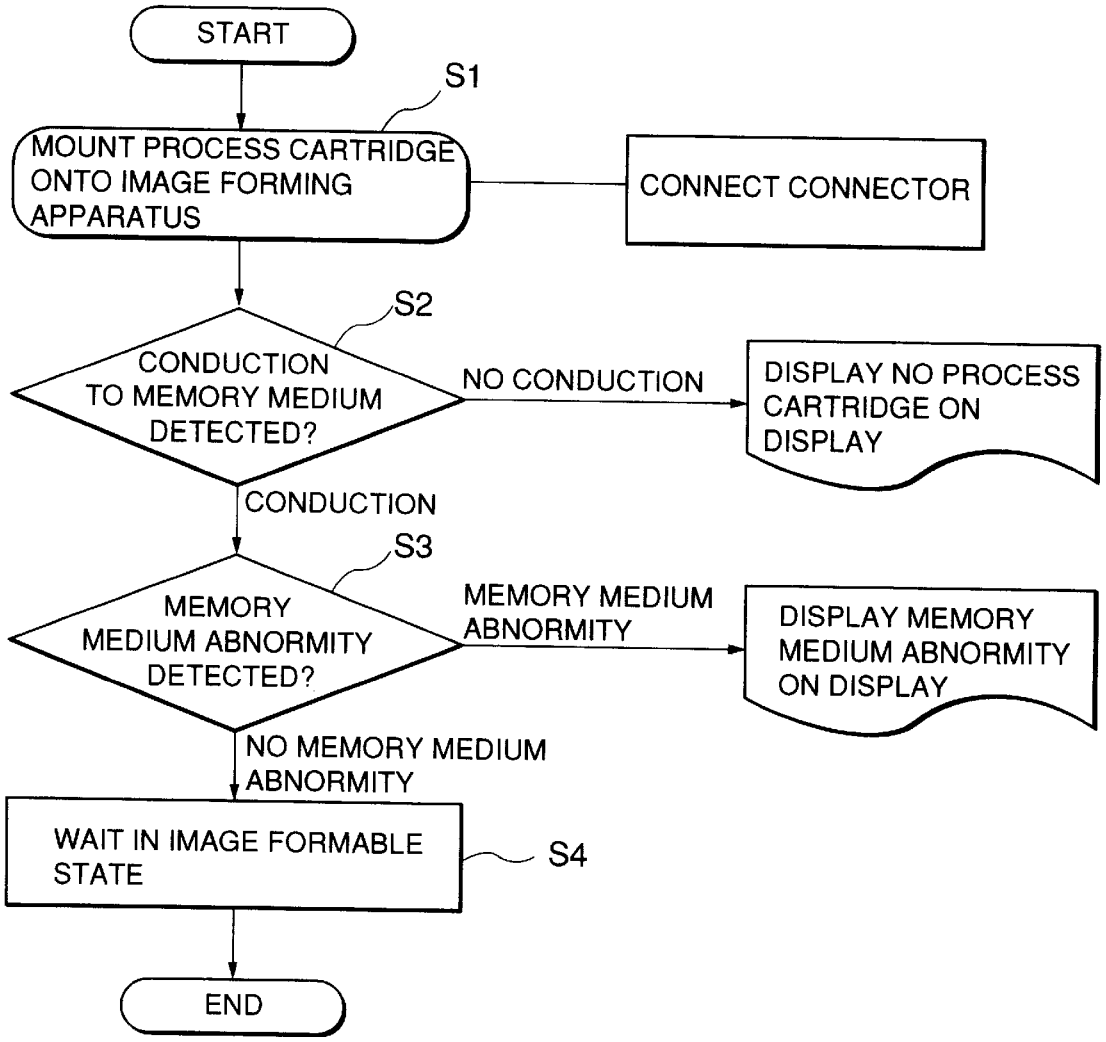
FIG. 14 is a flowchart showing the procedure of detecting the presence/absence of a cartridge and a memory medium abnormality in mounting the process cartridge onto a conventional image forming apparatus.

FIGURE 14,
"ABNORMITY" (all occurrences) should read --ABNORMALITY--.

COLUMN 3,
Line 25, "comprising" should read --comprising:--; and
Line 50, "cartridges;" should read --cartridge;--.

COLUMN 5,
Line 13, "P such," should read --P, such--.

UNITED STATES PATENT AND TRADEMARK OFFICE

CERTIFICATE OF CORRECTION

PATENT NO. : 5,909,603

DATED : June 1, 1999

INVENTOR(S) : JUN SUZUKI, ET AL.

It is certified that error appears in the above-identified patent and that said Letters Patent is hereby corrected as shown below:

COLUMN 11,
Line 9, "detecting," should read --detecting--; and
Line 29, "starts" should read --starting--.

Signed and Sealed this
Fourth Day of January, 2000

*Attest:*

*Attesting Officer*

*Acting Commissioner of Patents and Trademarks*